US007238050B2

(12) United States Patent
Sakakura et al.

(10) Patent No.: US 7,238,050 B2
(45) Date of Patent: Jul. 3, 2007

(54) SHIELDED CONNECTOR

(75) Inventors: Kouji Sakakura, Yokkaichi (JP); Tetsuya Shinozaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/342,443

(22) Filed: Jan. 30, 2006

(65) Prior Publication Data

US 2006/0172602 A1 Aug. 3, 2006

(30) Foreign Application Priority Data

Feb. 2, 2005 (JP) ..... 2005-026946

(51) Int. Cl.
*H01R 9/03* (2006.01)

(52) U.S. Cl. ..... 439/610; 439/157

(58) Field of Classification Search ..... 439/157, 439/152, 159, 607, 610, 372
See application file for complete search history.

(56) References Cited

U.S. PATENT DOCUMENTS

| | | | | |
|---|---|---|---|---|
| 4,685,758 | A | 8/1987 | Yoshida | |
| 5,244,415 | A | 9/1993 | Marsilio et al. | |
| 5,658,170 | A | 8/1997 | Tan et al. | |
| 5,928,011 | A * | 7/1999 | Flask et al. | 439/157 |
| 5,997,349 | A | 12/1999 | Yoshioka | |
| 6,183,275 | B1 * | 2/2001 | Okura et al. | 439/157 |
| 6,361,356 | B1 * | 3/2002 | Heberlein et al. | 439/489 |
| 6,929,512 | B2 * | 8/2005 | Lai | 439/610 |
| 2003/0060084 | A1 * | 3/2003 | Aoki | 439/610 |
| 2004/0147167 | A1 * | 7/2004 | Lai | 439/610 |
| 2004/0259421 | A1 | 12/2004 | Lai | |
| 2004/0266265 | A1 | 12/2004 | Hayashi | |
| 2005/0130496 | A1 * | 6/2005 | Ko | 439/610 |

FOREIGN PATENT DOCUMENTS

| | | |
|---|---|---|
| EP | 1 075 044 A1 | 2/2001 |
| JP | 2002-319548 | 10/2002 |

* cited by examiner

*Primary Examiner*—Hien Vu
(74) *Attorney, Agent, or Firm*—Gerald E. Hespos; Anthony J. Casella

(57) ABSTRACT

A connection shell (23) includes a tubular fastener (25) formed by flat surfaces (25*a*) and curved surfaces (25*b*) and a rectangular tubular contact (24). A crimp ring (29) is crimped to fasten a wire shield (28) to the outer peripheral surface of the tubular fastener (25). The tubular contact (24) is connected so that a circumferential surface thereof overlaps a circumferential surface of a housing shell (19). The tubular contact (24) has a rectangular shape that conforms with the rectangular tubular shape of the housing shell (19). Thus, only a small clearance is defined between the housing shell (19) and the connection shell (23) to suppress leakage of noise through the clearance between the housing shell (19) and the connection shell (23).

10 Claims, 12 Drawing Sheets

SHIELDED CONNECTOR

BACKGROUND OF THE INVENTION

1. Field of the Invention

The present invention relates to a shielded connector.

2. Description of the Related Art

Japanese Unexamined Patent Publication No. 2002-319458 discloses a shielded connector that has terminal fittings accommodated in a housing made of synthetic resin. A metallic tubular shell is assembled to the housing and substantially surrounds the housing for shielding. The housing shell absorbs noise from the terminal fittings to prevent leakage of the noise from the housing.

A braided wire shield surrounds the wires drawn from the housing to shield the wires together, and a metallic tubular shielding connection shell connects the wire shield and the housing shell. The connection shell and the housing shell are brought into contact so that their peripheral surfaces overlap.

The wire shield is connected with the connection shell by crimping a crimp ring. A crimp ring with an oblong or elliptical shape is considered to exhibit a better fastening strength than an initially rectangular crimp ring. However, the housings generally are in the form of rectangular blocks, and the housing shells generally are rectangular tubes.

Thus, large clearances unavoidably are produced between the arcuate portions of the connection shell and the angled portions of the housing shell when connecting a rectangular housing shell to a connection shell that has large arcuate portions. Noise can leak to the outside through these clearances.

The present invention was developed in view of the above problem, and an object thereof is to reduce or suppress the leakage of noise.

SUMMARY OF THE INVENTION

The invention relates to a shielded connector with a housing for accommodating at least one terminal fitting. A rectangular tubular housing shell is provided in or on the housing and substantially surrounds the terminal fittings for shielding. A wire shield at least partly surrounds the wires connected to the terminal fittings and drawn out of the housing, and a conductive connection shell connects the wire shield and the housing shell. The connection shell includes a tubular fastener with at least one flat surface and at least one curved surface. The connection shell further includes a rectangular tubular contact located before the tubular fastener. The tubular contact is connected so that a peripheral surface of the tubular contact and a peripheral surface of the housing shell at least partly overlap each other.

The wire shield preferably is fastened to the outer peripheral surface of the tubular fastener by crimping a crimp ring.

The housing shell and the tubular contact preferably are substantially rectangular tubes.

The tubular contact and the housing shell preferably have complementary rectangular tubular shapes. Thus, the peripheral surfaces of the housing shell and the connection shell contact and overlap each other without creating large clearances. Accordingly, leakage of noise through the clearance between the connection shell and the housing shell is suppressed. Further, the tubular fastener has the flat surfaces and the curved surfaces, and has no angled portions. Therefore, crimping the crimp ring is not hindered.

The tubular fastener and the tubular contact preferably are coupled by at least one coupling substantially in the form of a flange that bulges out from the tubular fastener.

The wire shield fit on the tubular fastener is stopped by the coupling so as not to move any further forward. Thus, a fastening area of the wire shield to the connection shell lies within a range of the tubular fastener and does not extend to the tubular contact.

At least one stopper is formed at the front end of the outer peripheral surface of the tubular fastener and behind the coupling for stopping the crimp ring so as not to move any further forward.

A dimension of the crimp ring along forward and backward directions preferably substantially equals a distance from the rear end of the tubular fastener to the rear end of the stopper.

The crimp ring and the coupling preferably are distanced to define a clearance along forward and backward directions. This clearance can be used as a visual confirmation space. More particularly, exposure of the wire shield in the clearance provides visual confirmation that the wire shield is fastened securely to the connection shell.

A fastening area of the wire shield to the connection shell preferably lies within a range of the tubular fastener and does not extend to the tubular contact.

The rectangular tubular contact preferably substantially conforms to the shape of the housing shell. Thus, the housing shell and the connection shell can be held in an overlapping contact over their entire peripheries without a large clearance between their peripheral surfaces.

A movable member, such as a lever, preferably is provided for displaying a cam action to connect the shielded connector with a mating shielded connector.

The connection shell preferably is retained by a holder assembled with the housing to hold the connection shell inseparably in the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
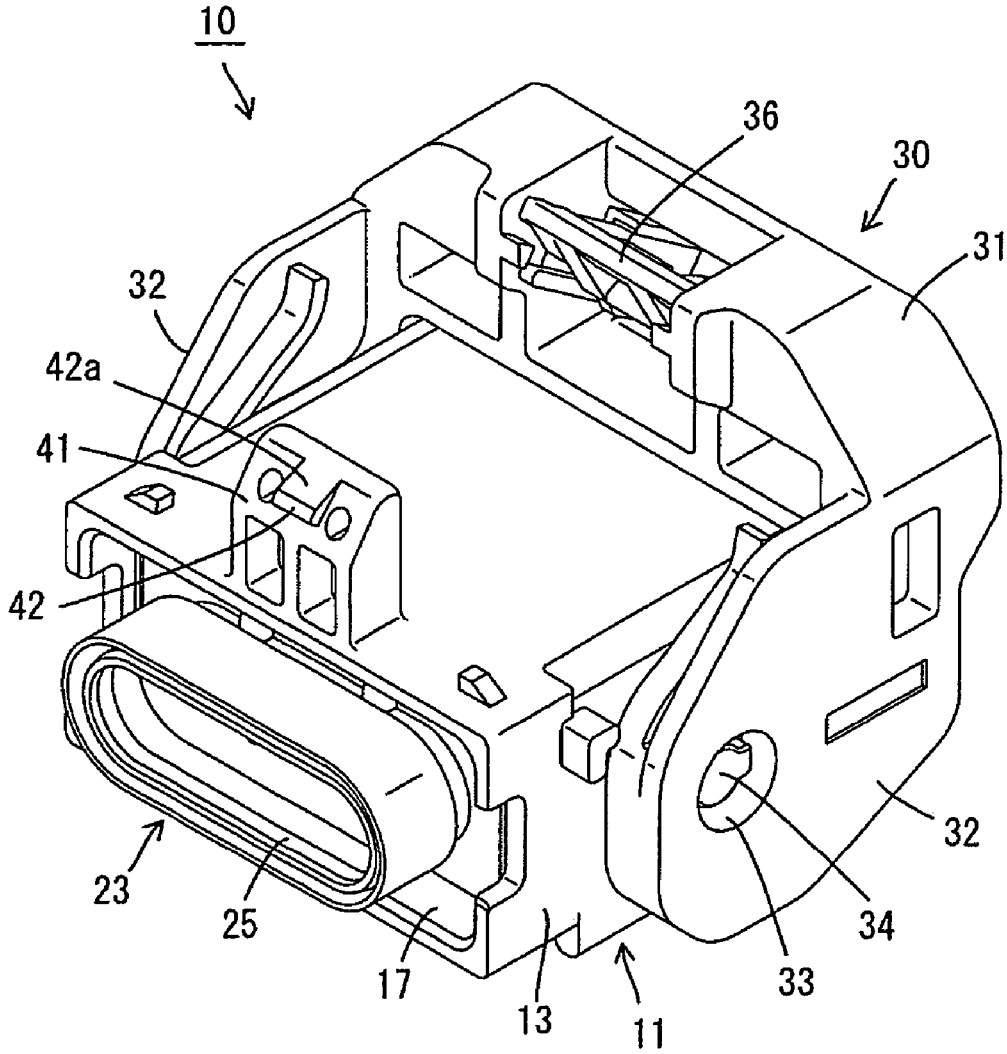
FIG. 1 is a perspective view of a first shielded connector according to a first embodiment.
Figure 2:
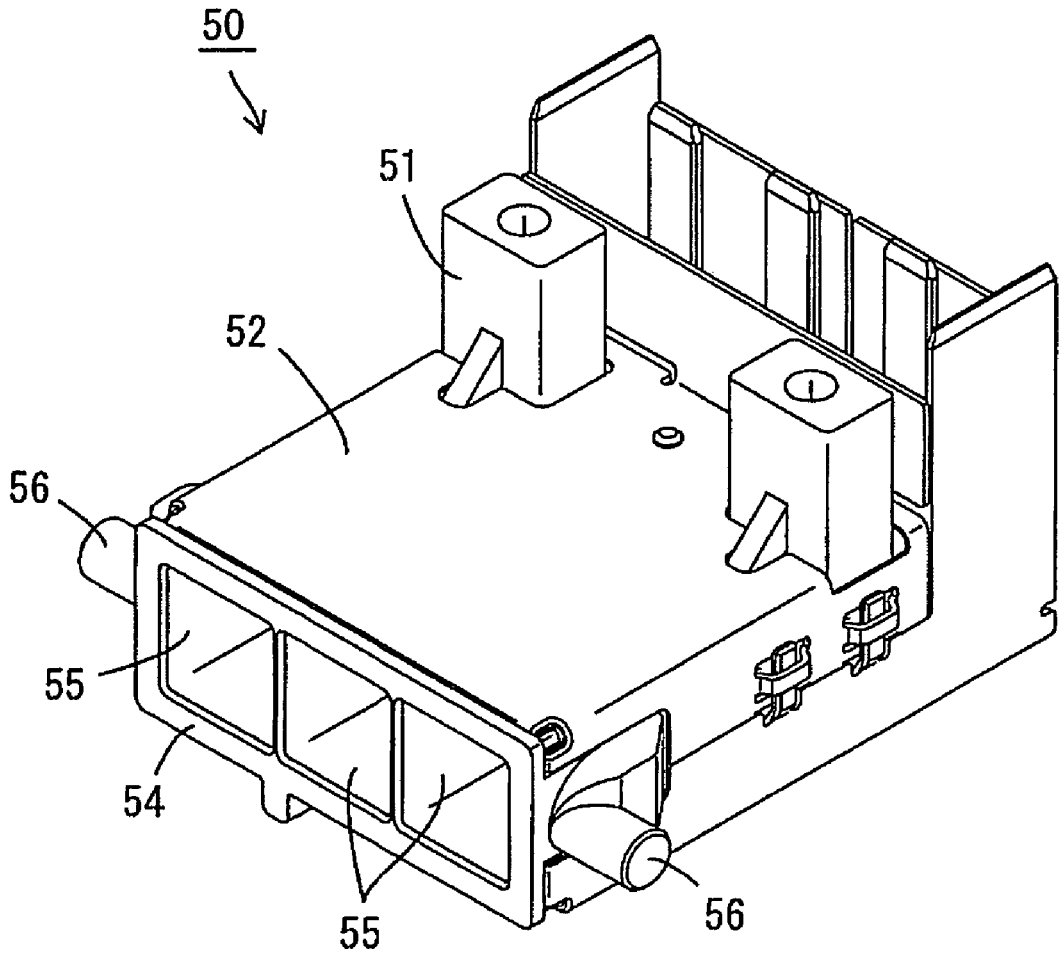
FIG. 2 is a perspective view of a second shielded connector.
Figure 3:
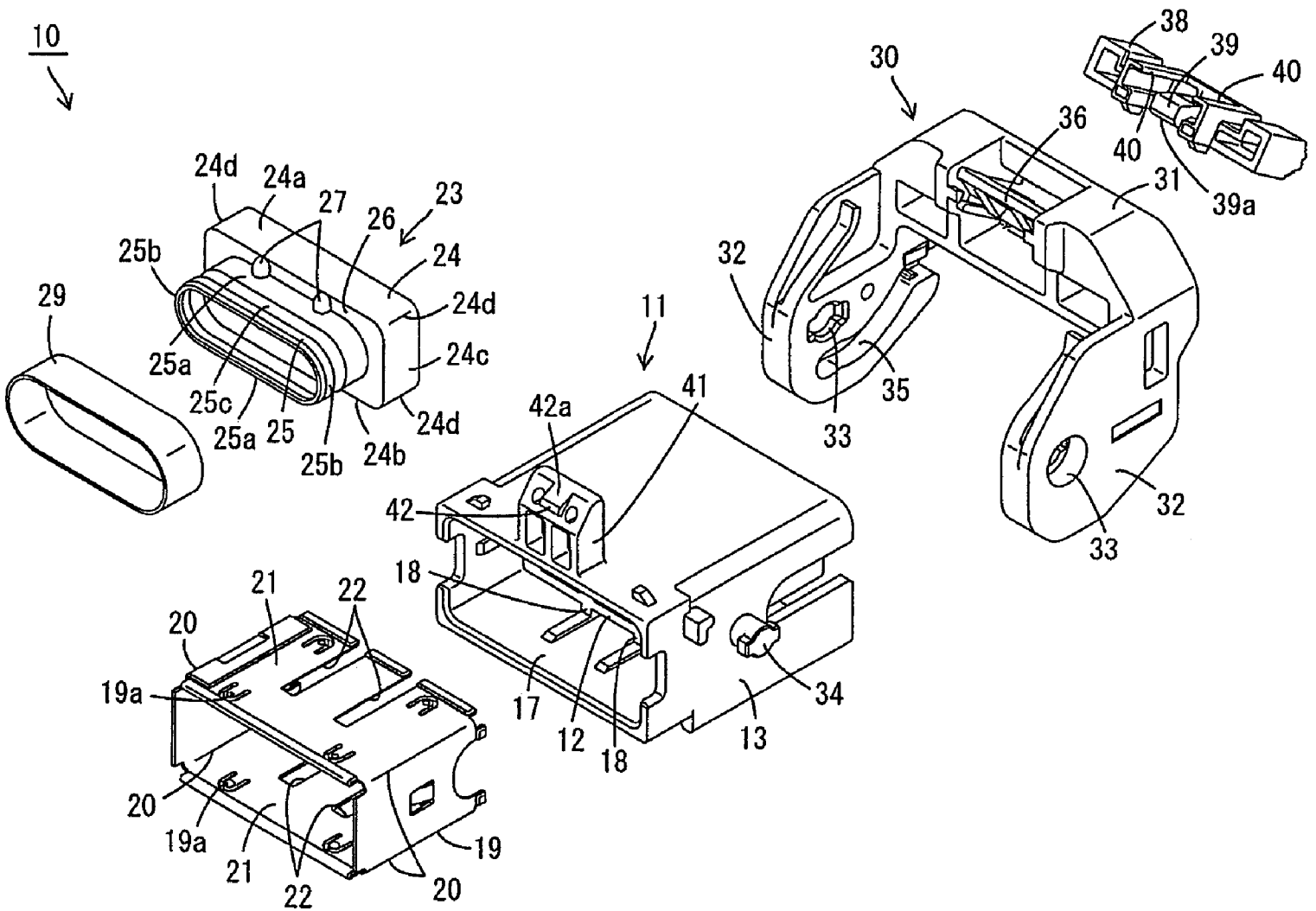
FIG. 3 is an exploded perspective view of the first shielded connector.

A shielded connector assembly in accordance with the invention is described with reference to FIGS. 1 to 13. The assembly includes first and second shielded connectors 10 and 50 that are connectable with each other.

The first shielded connector 10 includes a first housing 11 that is molded unitarily e.g. of a synthetic resin and has block-shaped terminal accommodating portions 12 arranged substantially side by side and coupled to each other at their rear ends. The first housing 11 also has a substantially rectangular tubular fitting 13 that surrounds the terminal accommodating portions 12. First terminal fittings 14 are inserted into the respective terminal accommodating portions 12 from behind and wires 15 are connected with the rear ends of the respective first terminal fittings 14 by crimping, bending, folding, insulation displacement, soldering or the like. Each wire 15 is unshielded and has a core surrounded by an insulation coating. The wires 15 are drawn out through the rear end of the terminal accommodating portion 12. The tubular fitting 13 is formed in an area from the front ends of the terminal accommodating portions 12 to a position behind the rear ends of the terminal accommodating portions 12 with respect to forward and backward directions. A substantially rectangular fitting space 16 is defined between the outer peripheral surfaces of the terminal accommodating portions 12 and the tubular fitting 13. The fitting space 16 has an open front end and is substantially continuous over the entire periphery. An accommodation space 17 is defined in the tubular fitting 13 behind the terminal accommodating portions 12. The terminal accommodating portions 12 and the tubular fitting 13 are coupled and held in a specified positional relationship by coupling ribs 18.

The first shielded connector further includes a housing shell 19 that is mounted to the first housing 11. The housing shell 19 has a substantially rectangular tubular shape and preferably has no seam in the peripheral direction. More particularly, the housing shell 19 preferably is formed by applying deep drawing to a conductive metal sheet (of, e.g. an aluminum alloy) to gradually deform the conductive metal sheet by repeating a plurality of pressing operations. The housing shell 19 has four right angled corners 20. Left and right slits 22 extend backward from the front end of the upper and lower plates of the housing shell 19 and substantially corresponding to the coupling ribs 18.

The housing shell 19 is assembled to the first housing 11 from behind and substantially along the inner peripheral surface of the tubular fitting 13 so that the slits 22 engage the coupling ribs 18. Thus, the outer peripheral surface of the housing shell 19 is held substantially in close contact with a major part of the inner peripheral surface of the tubular fitting 13. A front portion of the housing shell 19 is in a rear portion of the fitting space 16, and a rear portion of the housing shell 19 is in the accommodation space 17. The housing shell 19 shields rear portions of the first terminal fittings 14 and areas of the wires 15 in the accommodation space 17 of the tubular fitting 13 by surrounding the wires 15 over substantially the entire periphery.

The first shielded connector 10 further includes a connection shell 23 connected with the housing shell 19. The connection shell 23 has a substantially tubular shape and preferably has no seam in a peripheral direction. More particularly, the connection shell 23 preferably is formed by applying deep drawing to a conductive metal sheet (e g. an aluminum alloy) to gradually deform the conductive metal sheet by repeating a plurality of pressing operations. A tubular contact 24 is defined at the front of the connection shell 23 for contacting the housing shell 19, whereas a substantially tubular fastener 25 is formed at the rear of the connection shell 23.

The tubular contact 24 has a wide rectangular shape and includes a horizontal upper wall 24*a*, a lower wall 24*b* substantially parallel to the upper wall 24*a*, and left and right side walls 24*c* extending substantially perpendicularly between the upper and lower walls 24*a* and 24*b* at the opposite left and right sides of the tubular contact 24. Accordingly, four substantially right-angled corners 24*d* are defined where the upper and lower walls 24*a* and 24*b* meet the side walls 24*c*. The corners 24*d* are bent with a very small radius of curvature, but with a larger radius of curvature than the angled portions 20 at the four corners of the housing shell 19.

The tubular fastener 25 has a wide oblong shape, and includes upper and lower horizontal substantially flat portions 25*a*, and left and right curved portions 25*b* substantially tangentially and smoothly connected with the left and right ends of the upper and lower flat portions 25*a*. Accordingly, the tubular fastener 25 has no angled portions bent with a small radius of curvature and is formed by the flat and curved surfaces that are smoothly continuous in peripheral directions. Further, the tubular fastener 25 is formed with a crimping groove 25 substantially continuous in peripheral direction. The crimping groove 25*c* is formed by recessing the outer peripheral surface of the tubular fastener 25 to have an arcuate inwardly projecting cross section.

The tubular contact 24 and tubular fastener 25 are coupled by a plate-like coupling 26 in the form of a flange extending from the front of the tubular fastener 25 over the entire periphery. The coupling 26 is continuous and substantially at right angle to both the tubular contact 24 and the tubular fastener 25. Left and right stoppers 27 project out from the front ends of each of the upper and lower flat portions 25*a* of the tubular fastener 25 adjacent the coupling 26. The stoppers 27 can be formed by embossing the coupling 26 to project back into the tubular fastener 25. A projecting distance of the stoppers 27 from the outer peripheral surface of the tubular fastener 25 is longer than the thickness of a crimp ring 29 to be described later, and a vertical area where the stoppers 27 are formed is a range from each flat portion 25*a* of the tubular fastener 25 to the upper or lower wall 24*a* or 24*b* of the tubular contact 24.

The shielding member 28 to be fastened to this connection shell 23 is for shielding wires 15 drawn back out of the first housing 11 by surrounding the wires 15 together. The preferred shielding member 28 is formed by braiding thin metallic wires into a flexible meshed tube or by a flexible conductive sheet or layer. A front end of the shielding member 28 is to be fastened to the connection shell 23 by a conductive metallic crimp ring 29. The crimp ring 29 is substantially in the form of an oblong tube having a shape similar to but slightly larger than the tubular fastener 25. A dimension of the crimp ring 29 along forward and backward directions is substantially equal to a distance from the rear end of the tubular fastener 25 to the rear ends of the stoppers 27, and hence is shorter than a dimension of the tubular fastener 25 along forward and backward directions.

The front end of the shielding member 28 is fit over and covers the entire outer periphery of the tubular fastener 25. Additionally, the front end of the shielding member 28 is telescoped into contact with the stoppers 27 to ensure a large fastening margin or overlap of the tubular fastener 25 and the shielding member 28 along forward and backward directions. The crimp ring 29 that had been fit on the shielding member 28 beforehand then is slid forward to face the outer peripheral surface of the tubular fastener 25. At this time, the front end of the crimp ring 29 is substantially in contact with the stoppers 27. The crimp ring 29 then is deformed plastically e.g. by a crimping machine (not shown) to reduce its dimensions and to achieve a crimped connection with the outer peripheral surface of the tubular fastener 25. In this way, the front end of the shielding member 28 is squeezed strongly and sandwiched between the outer peripheral surface of the tubular fastener 25 and the inner peripheral surface of the crimp ring 29 to fasten the tubular fastener 25 and the crimp ring 29, to establish an electrical connection and to prevent the tubular fastener 25 and the crimp ring 29 from being separated from each other. Further, part of the crimped crimp ring 29 is plastically deformed into the crimping groove 25*c* so that the tubular fastener 25 and the shielding member 28 catch each other along forward and backward directions in the crimping groove 25*c*.

Figure 4:
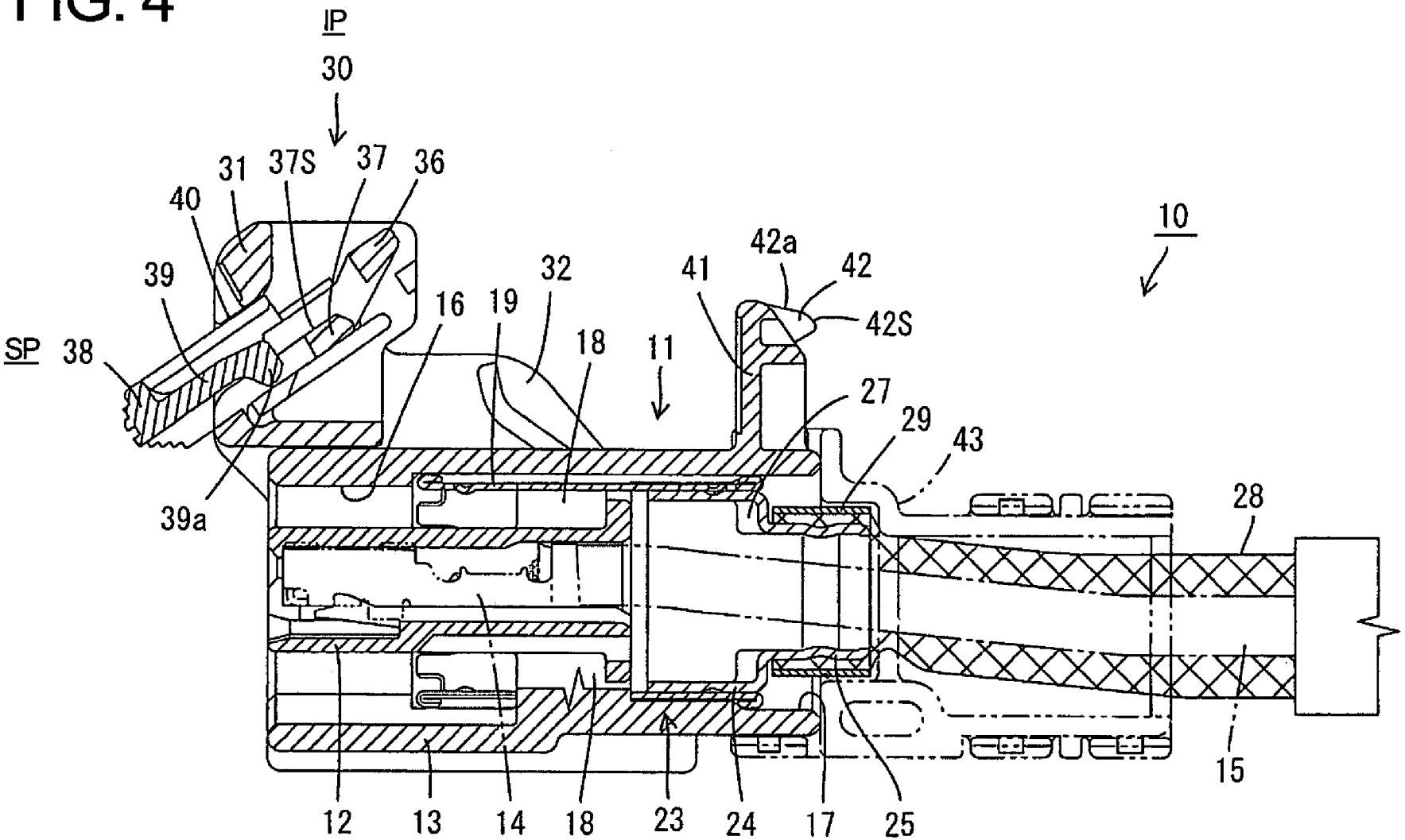
FIG. 4 is a section of the first shielded connector.
Figure 5:
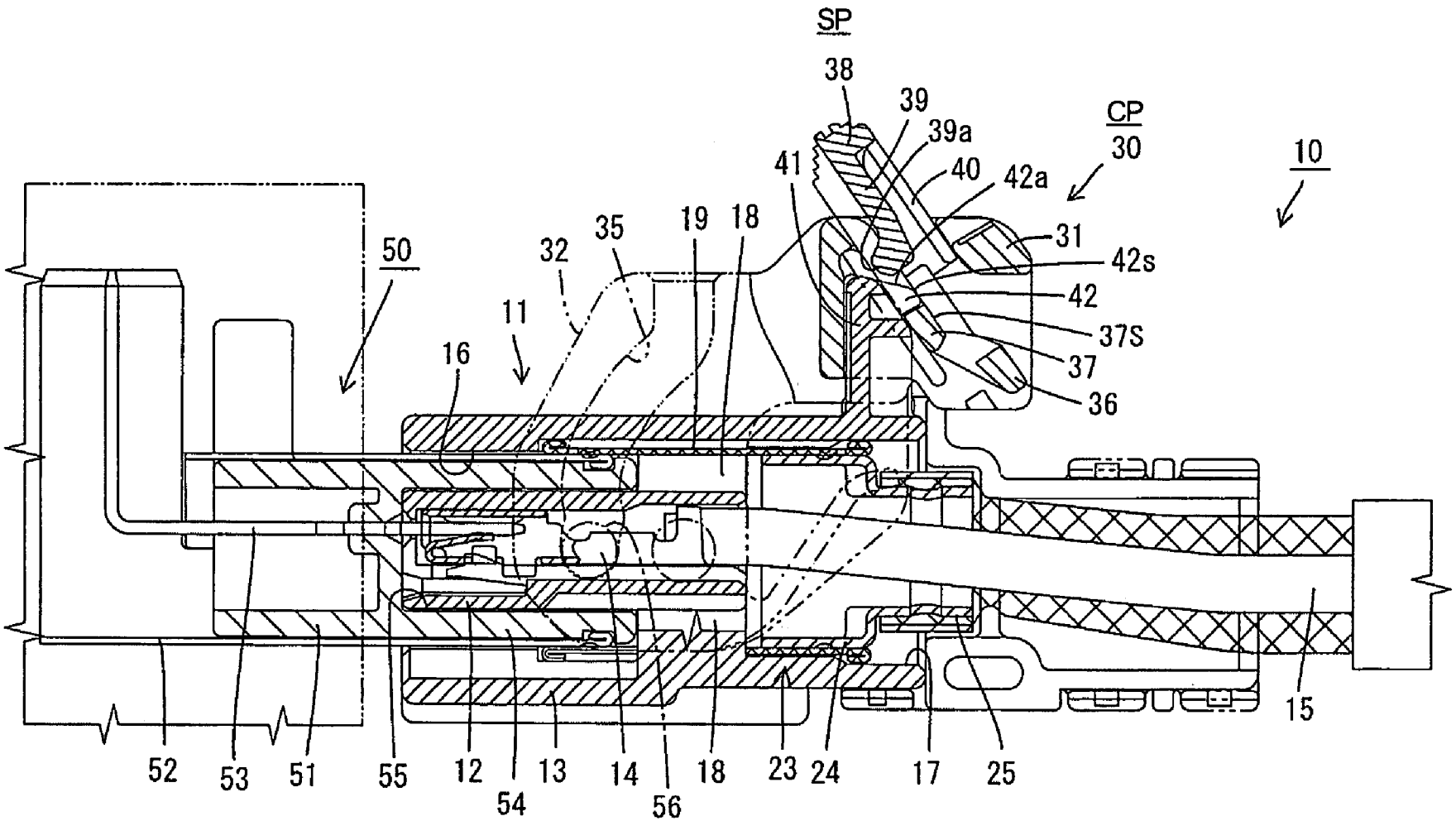
FIG. 5 is a section showing a state where the first and second shielded connectors are connected.

The lever 30 has an operable portion 31 and two plate-like arms 32 that extend from the opposite ends of the operable portion 31. The arms 32 are mounted to lie along the outer side surfaces of the tubular fitting 13 of the first housing 11, and bearing holes 33 of the arms 32 rotatably engage supporting shafts 34 on the left and right surfaces of the tubular fitting 13. A cam groove 35 is formed in the inner surface of each arm 32. The operable portion 31 is formed unitarily with a lock arm 36 that is resiliently deformable in an unlocking direction away from the outer surface of the first housing 11. A displaceable latch 37 is formed unitarily with the lock arm 36. A detector 38 is assembled with the operable portion 31 and has a resilient locking piece 39. The detector 38-is substantially linearly displaceable relative to the operable portion 31 in substantially the same direction as a displacing direction of the operable portion 31 during rotation of the lever 30. The resilient locking piece 39 is resiliently deformable in a disengaging direction substantially away from the outer surface of the first housing 11. The detector 38 also is formed with a preventing portion 40 that is not resiliently deformable. In an unconnected state of both shielded connectors 10, 50, the detector 38 is at a standby position SP where the resilient locking piece 39 is behind the latch 37 with respect to a rotating direction of the lever 30, as shown in FIGS. 4 and 5. A lock 41 projects from the rear end of the upper surface of the tubular fitting 13 and is formed with a lock projection 42.

The second shielded connector 50 includes a second housing 51, a shielding shell 52, and second terminal fittings 53. The second housing 51 is made e.g. of a synthetic resin, and has a receptacle 54 formed at the front end. The receptacle 54 is configured to fit into the fitting space 16. The receptacle 54 is partitioned into fitting recesses 55 having opening front ends, and front ends of the second terminal fittings 53 are accommodated in the respective fitting recesses 55. The second terminal fittings 53 are long narrow male terminal fittings. Substantially cylindrical cam followers 56 project out from the left and right outer side surfaces of the second housing 51. A rectangular tubular shielding shell 52 is mounted in close contact with the outer peripheral surface of the second housing 51. The shielding shell 52 is a united assembly of upper and lower divided elements, and surrounds substantially the entire area of the second housing 51 from the front end to the rear end over substantially the entire periphery.

Figure 7:
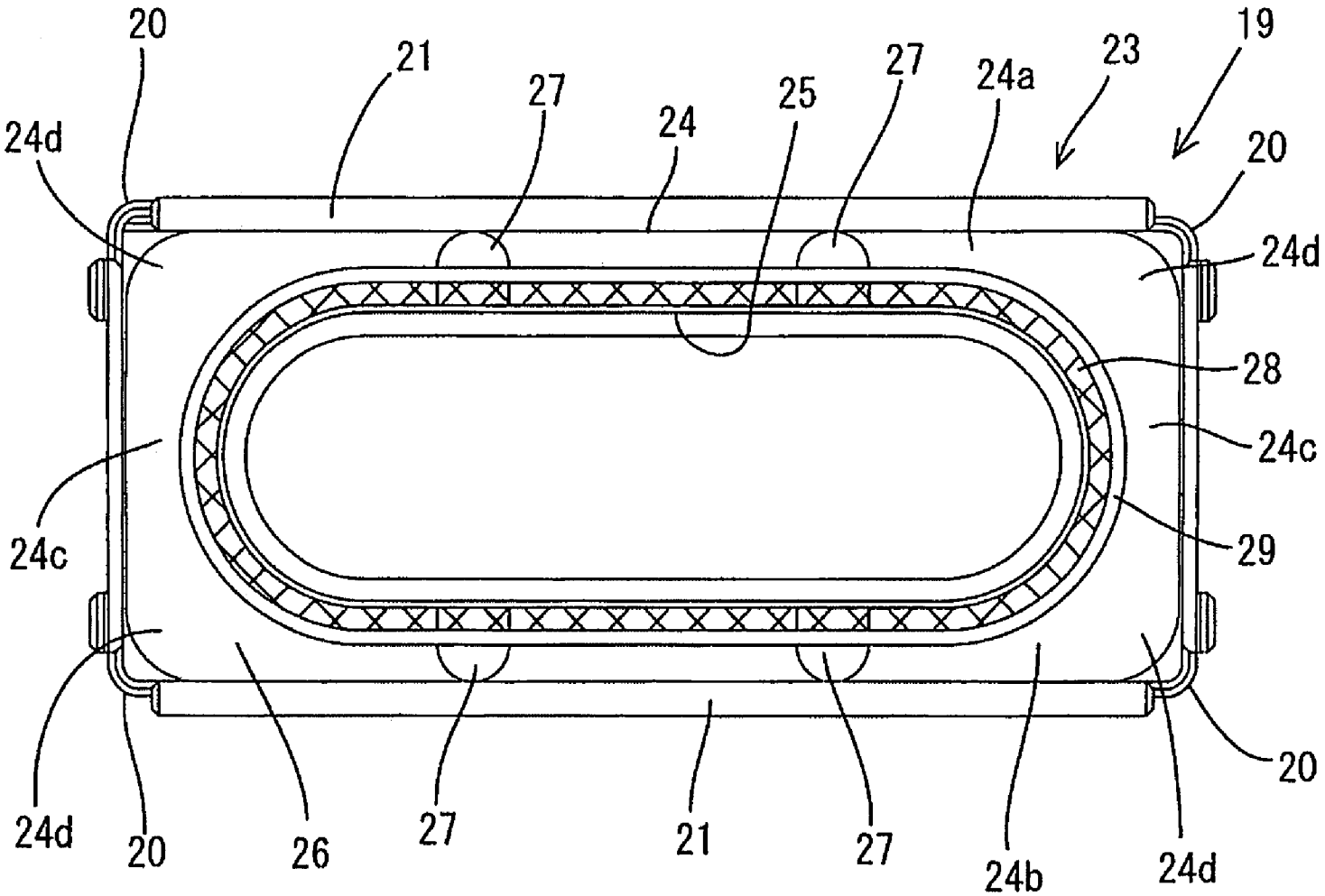
FIG. 7 is a section showing a state where a housing shell and a connection shell are connected.
Figure 8:
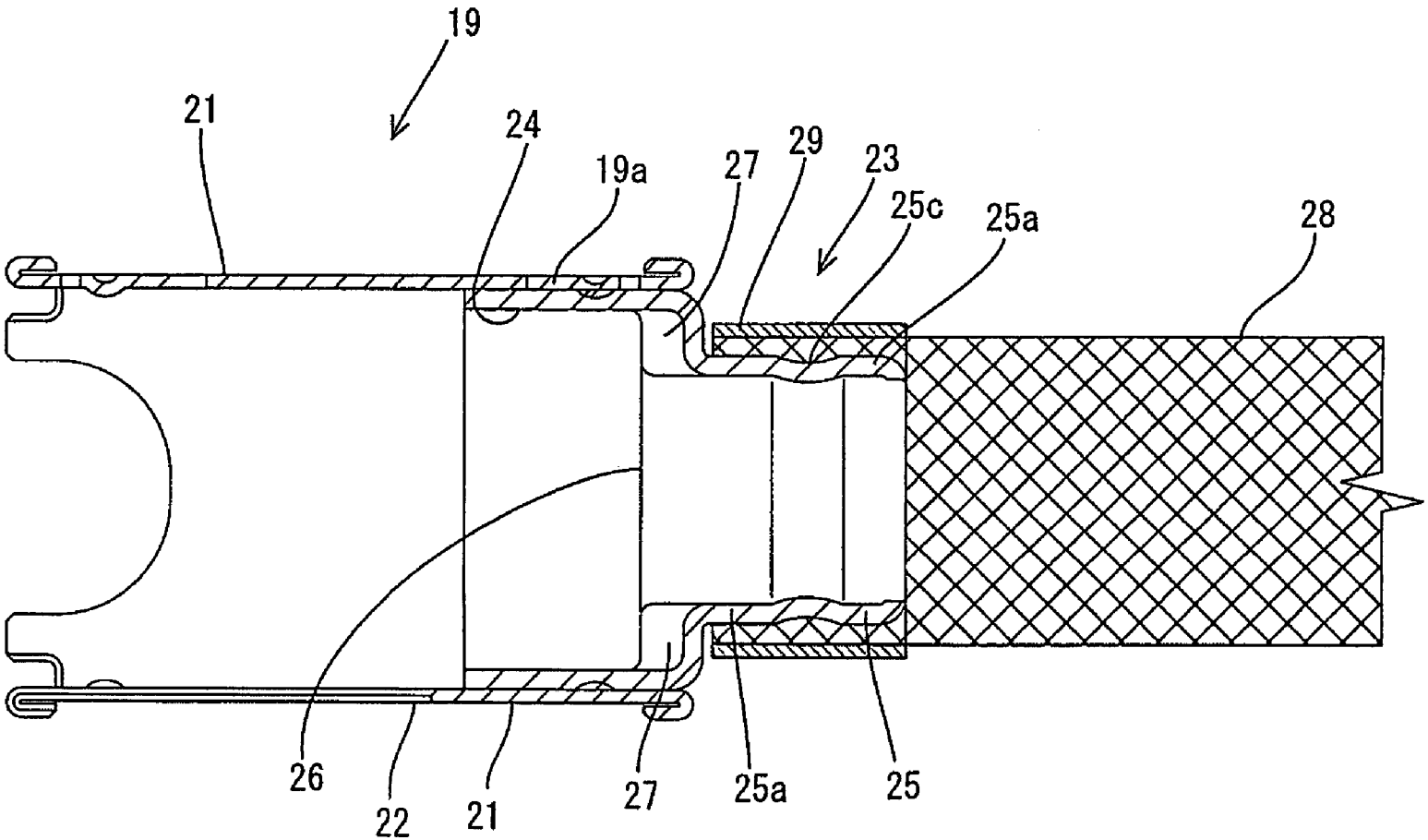
FIG. 8 is a rear view showing the state where the housing shell and the connection shell are connected.
Figure 9:
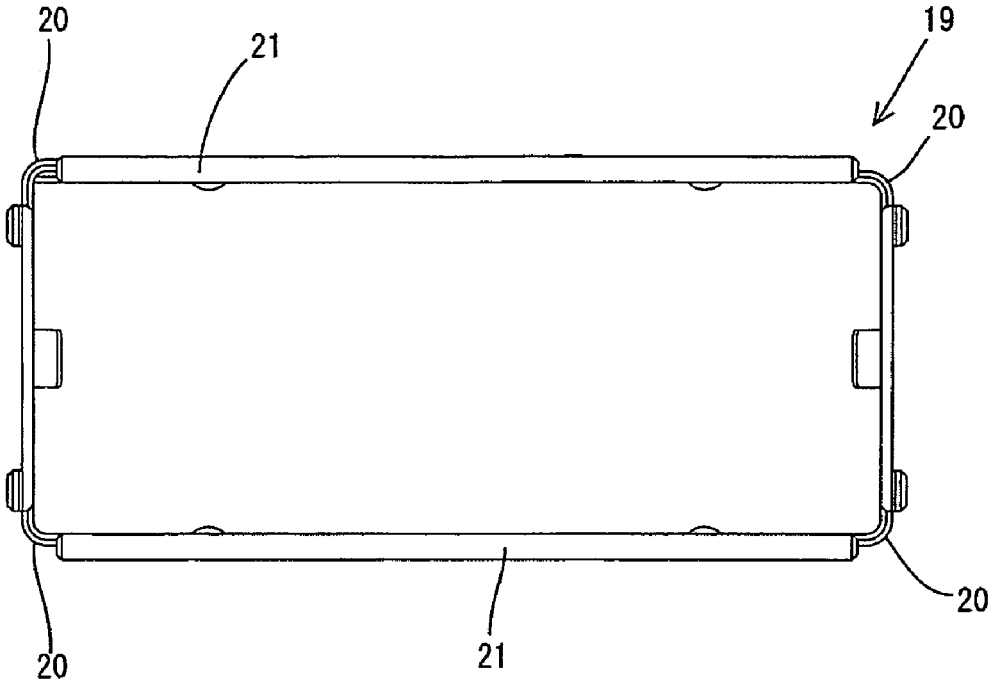
FIG. 9 is a rear view of the housing shell.
Figure 10:
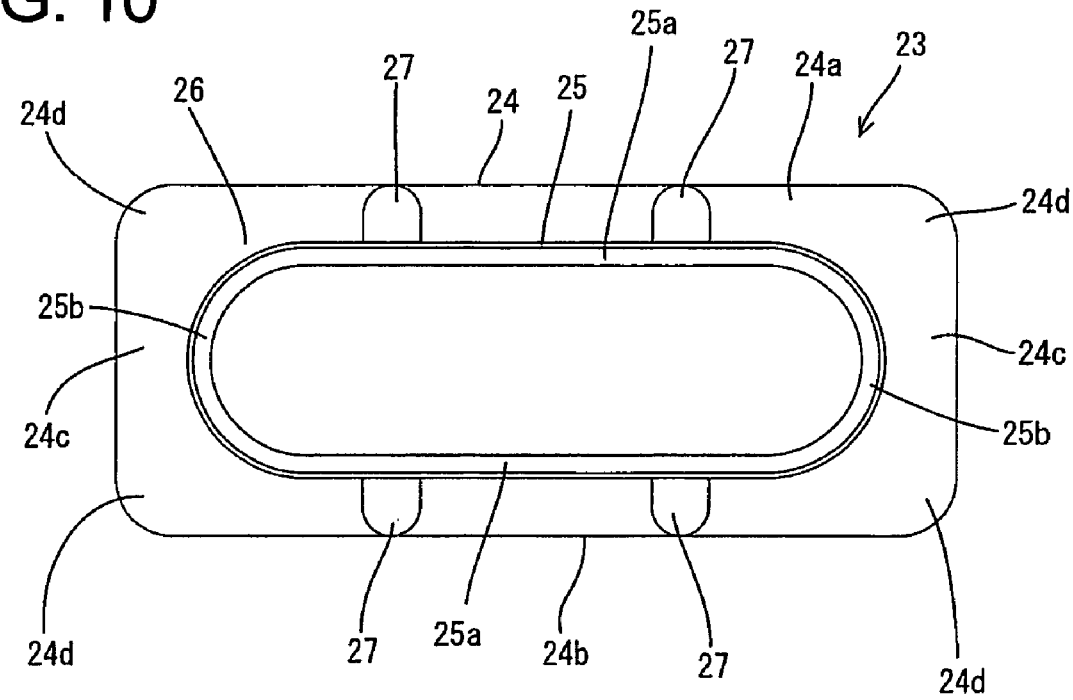
FIG. 10 is a rear view of the connection shell.
Figure 11:
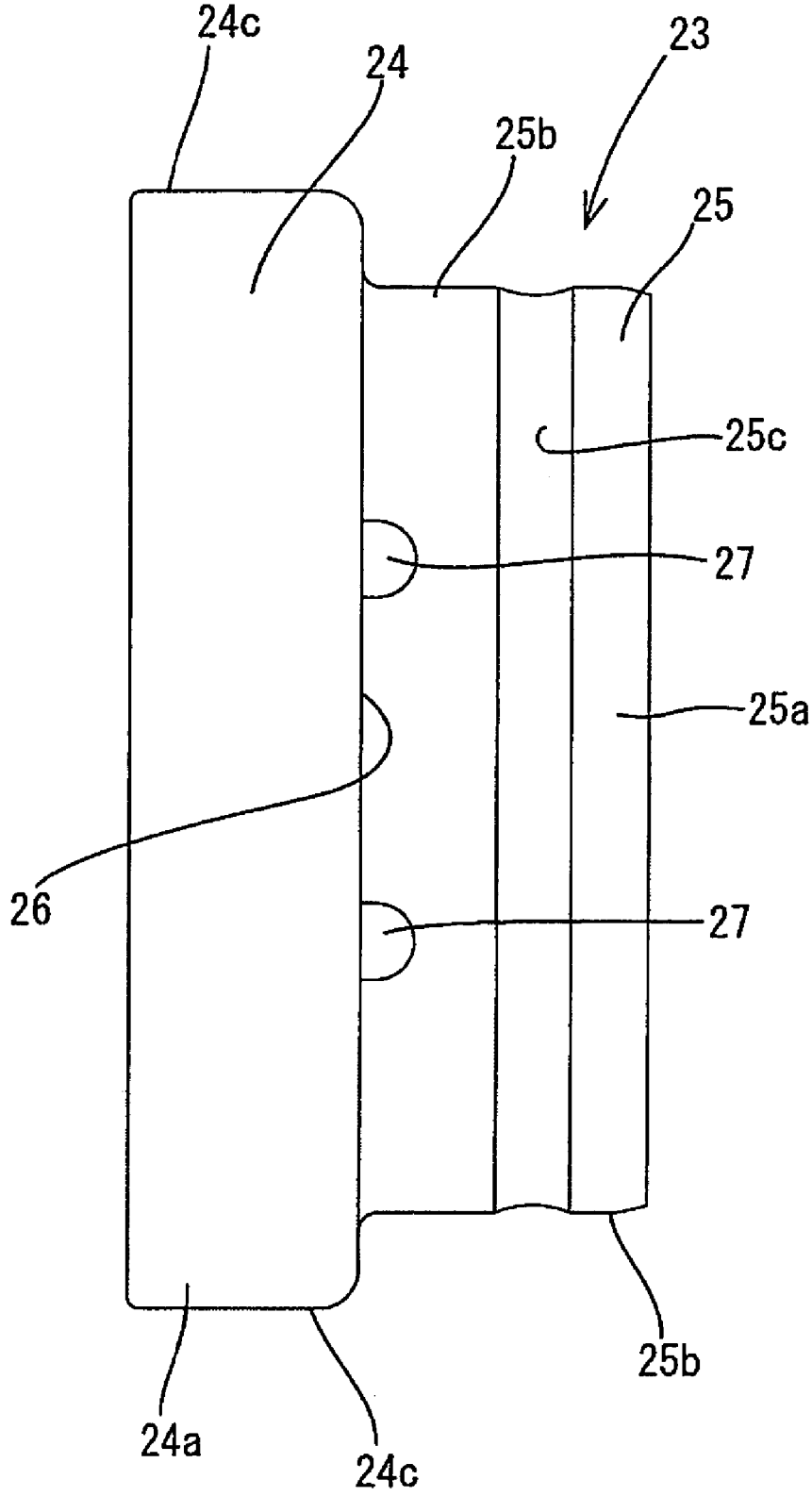
FIG. 11 is a plan view of the connection shell.
Figure 12:
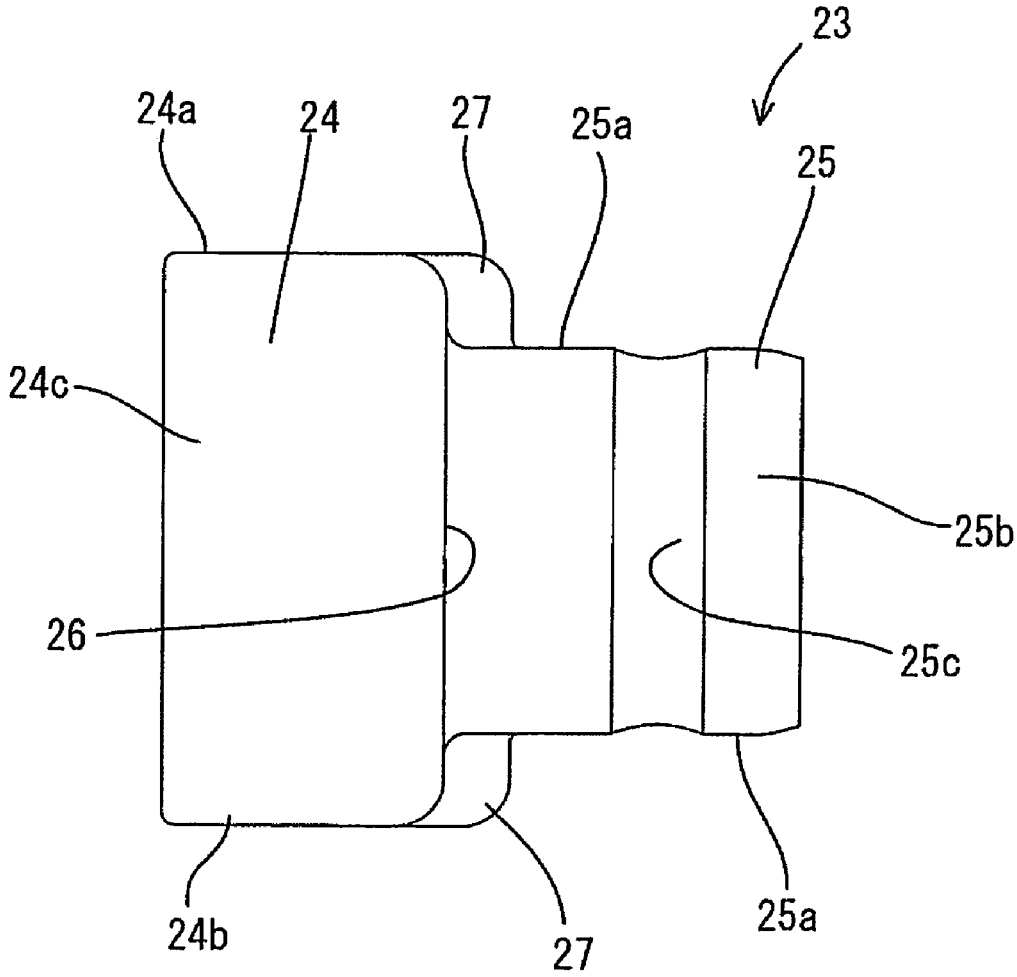
FIG. 12 is a side view of the connection shell.
Figure 13:
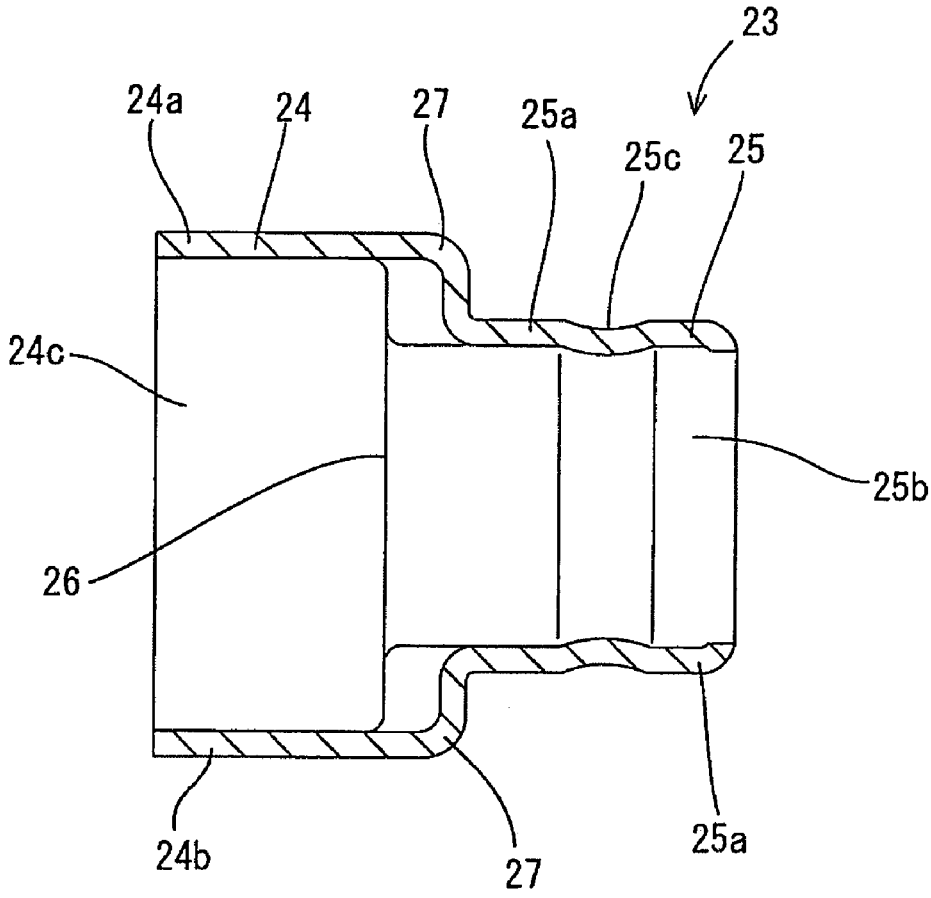
FIG. 13 is a section of the connection shell.

The connection shell 23 having the shielding member 28 fastened thereto is inserted into the accommodation space 17 of the first housing 11 from behind to fit the tubular contact 24 into the housing shell 19 in the accommodation space 17. In this state, resilient contact pieces 19*a* on the upper and lower plates of the housing shell 19 contact the outer peripheral surface of the tubular contact portion 24. Thus, the connection shell 23 and the housing shell 19 are connected electrically so that their peripheral surfaces overlap. The tubular contact 24 and the housing shell 19 are both substantially rectangular. Thus, no large clearances are produced between the outer peripheral surface of the connection shell 23 and the inner peripheral surface of the housing shell 19 at four corners as shown in FIG. 7.

The connection shell 23 fitted into the accommodation space 17 is stopped so as not to move any further forward by the contact of the front edge of the tubular contact 24 with the coupling ribs 18, and is retained by a holder 43 assembled with the rear end of the first housing 11. As a result, the connection shell 23 is inseparably held in the first housing 11.

The receptacle 54 is fit lightly into the fitting space 16 and the terminal accommodating portions 12 are fit lightly fitted into the fitting recesses 55 with the lever 30 held at an initial position IP shown in FIG. 4. Thus, the cam followers 56 enter the entrances of the cam grooves 35. The lever 30 then is rotated in a connecting direction to a connecting position CP. Thus, the two shielded connectors 10, 50 are pulled towards each other by a cam action of the engagement of the cam followers 56 and the cam grooves 25. The shielding shell 52 is fit in the housing shell 19 and the two shells 19, 52 are connected electrically when the lever 30 reaches the connection position CP shown in FIG. 5 to connect the two shielded connectors 10, 50 properly. Further, the front sides of the second terminal fittings 53 enter the terminal accommodating portions 12 to connect electrically with the first terminal fittings 14. The rear portions of the first terminal fittings 14 are surrounded by the housing shell 19, as described above, and the front portions thereof become surrounded by the shielding shell 52 as the two shielded connectors 10, 50 are connected. Thus, electrically conductive paths formed by the first and second terminal fittings 14, 53 in the first and second housings 11, 51 are shielded by the housing shell 19 and the shielding shell 52.

The lock arm 36 is deformed resiliently in the unlocking direction and the latch 37 moves onto the lock projection 42 immediately before the two shielded connectors 10, 50 are connected properly. The lock arm 36 is restored resiliently when the lever 30 reaches the connection position CP and the latch 37 engages the lock projection 42. In this way, the lever 30 is locked at the connection position CP and is prevented from rotating towards the initial position IP.

Thereafter, the detector 38 is moved from the standby position SP to a detecting position DP by being pushed substantially in the same direction as the rotating direction of the lever 30 toward the connection position CP. In the moving process, the resilient locking piece 39 is deformed resiliently in a disengaging direction. Thus, the locking projection 39*a* of the resilient locking piece 39 moves onto an inclined surface 42a of the lock projection 42, passes an outer surface 42S of the lock projection 42 and moves onto an outer surface 37S of the latch 37. At this time, the outer surface 42S of the lock projection 42 and the outer surface 37S of the latching portion 37 are substantially continuous and substantially flush with each other and at substantially the same height without defining a clearance therebetween. Thus, the locking projection 39*a* can smoothly slide on both outer surfaces 42S, 37S without getting caught. In other words, the detector 38 can be pushed from the standby position SP to the detecting position DP by one action.

Figure 6:
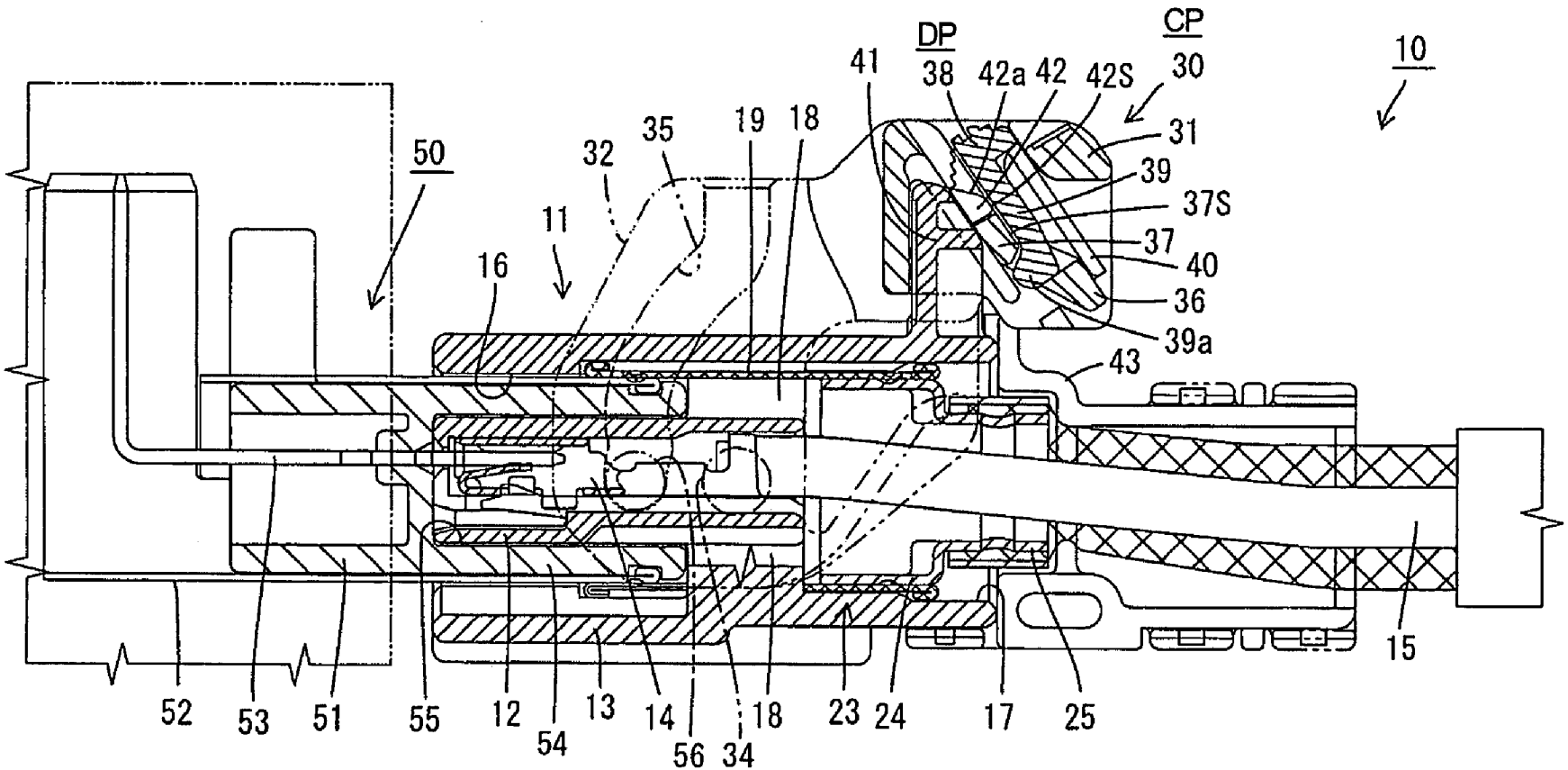
FIG. 6 is a section showing a state where the first and second shielded connectors are connected and a detecting member is moved to a detecting position.

The resilient locking piece 39 is restored resiliently when the detector 38 reaches the detecting position DP and the locking projection 39*a* engages the latch 37. In this way, the detector 38 is locked at the detecting position DP and prevented from returning towards the standby position SP. In this state, the outer surface of the lock arm 36 contacts the preventing portion 40 of the detector 38, as shown in FIG. 6, thereby preventing the lock arm 36 from being deformed in an unlocking direction. As a result, the lock arm 36 and the lock projection 42 are engaged securely, and the two shielded connectors 10, 50 are locked securely in their connected state.

Upon separating the two shielded connectors 10, 50 in this state, the detector 38 is pushed from the detecting position DP to the standby position SP. Then, due to the inclinations of the locking projection 39*a* and the inclined surface of the latch 37, the locking projection 39*a* moves onto the latch 37 and passes the lock projection 42 while the resilient locking piece 39 is deformed in disengaging direction. As a result, the detector 38 returns to the standby position SP. Since the resilient deformation of the lock arm 36 in unlocking direction is permitted in this way, the lock arm 36 is deformed resiliently to disengage the latch 37 from the lock projection 42 and the lever 30 can be rotated from the connection position CP to the initial position IP. As the lever 30 is rotated, the two shielded connectors 10, 50 are moved in separating directions by the cam action of the engagement of the cam grooves 35 and the cam followers 56.

As described above, the connection shell 23 includes the tubular fastening portion 25 having the flat surfaces 25*a* and the curved surfaces 25*b*, and the rectangular tubular contact 24 located before the tubular fastener 25. The shielding member 28 is fastened to the outer peripheral surface of the tubular fastener 25 preferably by crimping the crimp ring 29; and the tubular contact 24 is connected so that the peripheral surface thereof and that of the housing shell 19 overlap each other.

The rectangular tubular contact 24 substantially in conforms to the shape of the housing shell 19. Thus, the housing shell 19 and the connection shell 23 can be held in contact in an overlapping manner without a large clearance between their peripheral surfaces. Thus, the leakage of noise through the clearance between the connection shell 23 and the housing shell 19 is suppressed effectively. Furthermore, the overall dimensions of the shielded connector are reduced advantageously. Further, since the tubular fastener 25 has the flat surfaces 25*a* and the curved surfaces 25*b* with no angles, the process of crimping the crimp ring 29 is not hindered.

The tubular fastener 25 and the tubular contact 24 are joined by the coupling 26, which bulges out from the front edge of the tubular fastener 25. Thus, the coupling 26 stops the forward movement of shielding member 28 and the crimp ring 29 on the tubular fastener 25. Further, a fastening area of the shielding member 28 to the connection shell 23 lies within a range of the tubular fastener 25 and does not extend to the tubular contact 24.

The stoppers 27 limit forward movement of the crimp ring 29 near the front end of the outer peripheral surface of the tubular fastener 25 and behind the coupling 26. Thus, the crimp ring 29 and the coupling portion 26 are distanced to define a clearance along forward and backward directions, and this clearance provides a visual confirmation space for exposing the front end of the shielding member 28. Specifically, the presence of the shielding member 28 in the clearance between the crimp ring 29 and the coupling 26 provides assurance that the crimp ring 29 was crimped into connection with the shielding member 28 in a sufficiently large area on the tubular fastener 25. In other words, whether the shielding member 28 is securely fastened to the connection shell 23 can be confirmed by visually confirming whether the shielding member 28 is exposed in the visual confirmation space.

The invention is not limited to the above described and illustrated embodiment. For example, the following embodiments are also embraced by the technical scope of the present invention as defined by the claims.

Although the tubular contact is so connected to overlap the inner peripheral surface of the housing shell in the foregoing embodiment, it may be connected to overlap the outer peripheral surface of the housing shell.

The coupling is substantially a flange bulging out from the front end of the tubular fastener in the foregoing embodiment. However, the coupling may be a flange bulging out from the rear edge of the tubular contact.

The tubular fastener has an oblong shape in the foregoing embodiment. However, the tubular fastener can have other shapes, such as a substantially elliptical shape or a right circular shape, provided that the tubular fastener has at least one flat surface and at least one curved surface.

The stoppers are formed by causing both the tubular fastener and the coupling portion to bulge out in the foregoing embodiment. However, they may be at positions of the tubular fastener distanced from the coupling.

The stoppers are formed by embossing in the foregoing embodiment, but they may be formed by cutting and bending.

The shielded connector has a lever that displays a cam action for assisting the connection with a mating shielded connector. However, a movable member other than a lever may be used, such as a slider. Furthermore, the invention also is applicable to shielded connectors with no movable member.

What is claimed is:

1. A shielded connector, comprising:

a resin housing for accommodating at least one terminal fitting, at least one wire connected to the terminal fitting and drawn out of the housing;

a rectangular tubular housing shell formed from a conductive metal and mounted into the housing for at least partly surrounding the terminal fitting;

a wire shield for at least partly surrounding the wire;

a conductive connection shell for connecting the wire shield and the housing shell, the connection shell having a tubular fastener with first and second opposed flat surfaces and first and second opposed curved surfaces extending between and connecting the flat surfaces, and a rectangular tubular contact extended from the tubular fastener, a peripheral surface of the tubular contact and a peripheral surface of the housing shell at least partly overlapping each other; and a crimp ring positioned on an outer peripheral surface of the tubular fastener and behind the tubular contact for fastening the wire shield to the outer peripheral surface of the tubular fastener.

2. The shielded connector of claim 1, wherein the housing shell and the tubular contact are substantially rectangular tubes.

3. The shielded connector of claim 1, wherein the tubular fastener and the tubular contact are coupled by a coupling that bulges out from the tubular fastener.

4. The shielded connector of claim 1, wherein a fastening area of the wire shield to the connection shell lies within a range of the tubular fastener and does not extend to the tubular contact.

5. The shielded connector of claim 1, wherein the tubular contact is a substantially rectangular tube with a shape substantially conforming with a shape of the housing shell, the housing shell and the connection shell being held in overlapping contact.

6. The shielded connector of claim 1, wherein a movable member is provided for displaying a cam action for assisting connection of the shielded connector with a mating shielded connector.

7. The shielded connector of claim 1, further comprising a holder for inseparably holding the connection shell in the housing.

8. A shielded connector comprising:

a housing for accommodating at least one terminal fitting, at least one wire connected to the terminal fitting and drawn out of the housing;

a rectangular tubular housing shell mounted to the housing for at least partly surrounding the terminal fitting;

a wire shield for at least partly surrounding the wire;

a conductive connection shell for connecting the wire shield and the housing shell, the connection shell having a tubular fastener with at least one flat surface and at least one curved surface, a rectangular tubular contact located before the tubular fastener, and a coupling bulging out from the tubular fastener and extending to the tubular contact, at least one stopper at an end of the outer peripheral surface of the tubular fastener and behind the coupling; and a crimp ring for fastening the wire shield to an outer peripheral surface of the tubular fastener wherein the at least one stopper is disposed for stopping the crimp ring so as not to move any further forward.

9. The shielded connector of claim 5, wherein a dimension of the crimp ring along forward and backward directions substantially equals a distance from a rear end of the tubular fastener to a rear end of the stopper.

10. A shielded connector comprising:

a housing for accommodating at least one terminal fitting, at least one wire connected to the terminal fitting and drawn out of the housing;

a rectangular tubular housing shell mounted to the housing for at least partly surrounding the terminal fitting;

a wire shield for at least partly surrounding the wire;

a conductive connection shell for connecting the wire shield and the housing shell, the connection shell having a tubular fastener with at least one flat surface and at least one curved surface, a rectangular tubular contact located before the tubular fastener, and a coupling bulging out from the tubular fastener to the tubular contact, a peripheral surface of the tubular contact and a peripheral surface of the housing shield at least partly overlapping each other; and a crimp ring for fastening the weird shield to an outer peripheral surface of the tubular fastener, wherein the crimp ring and the coupling are distanced to define a clearance along forward and backward directions, the clearance defining a visual confirmation space for exposing the shield and enabling a visual confirmation of whether the wire shield is fastened securely to the connection shell.

* * * * *